United States Patent [19]

Tiggesbaumker et al.

[11] 4,089,477

[45] May 16, 1978

[54] ADJUSTABLE LIFTING WALL FOR TUBE MILL

[75] Inventors: Peter Tiggesbaumker, Oelde; Karl-Heinz Alker, Ahlen, both of Germany

[73] Assignee: Polysius AG, Neubeckum, Germany

[21] Appl. No.: 775,694

[22] Filed: Mar. 9, 1977

[30] Foreign Application Priority Data

Mar. 26, 1976 Germany ..... 2613062

[51] Int. Cl.[2] ..... B02C 17/02

[52] U.S. Cl. ..... 241/78; 241/171; 241/181

[58] Field of Search ..... 241/70–72, 241/76, 78, 79.2, 79.3, 171, 181

[56] References Cited

U.S. PATENT DOCUMENTS

| | | | |
|---|---|---|---|
| 3,799,458 | 3/1974 | Crossmann | 241/171 X |
| 3,801,025 | 4/1974 | Slegten | 241/70 |
| 3,990,644 | 11/1976 | Hanke et al. | 241/181 X |

*Primary Examiner*—Roy Lake
*Assistant Examiner*—Howard N. Goldberg
*Attorney, Agent, or Firm*—Jones, Thomas & Askew

[57] ABSTRACT

This invention relates to a lifting wall for incorporation in a tube mill having two support plates divided into segments, intermediately disposed radially adjustable lifting vanes and a central transfer cone.

5 Claims, 4 Drawing Figures

ADJUSTABLE LIFTING WALL FOR TUBE MILL

BACKGROUND OF THE INVENTION

Lifting walls in tube mills are intended to separate the grinding body fillings of adjacent grinding chambers from each other, and to convey from one chamber to the other the material being ground.

In order to optimise the grinding process it is important for the time spent by the material in the individual chambers to be matched as precisely as possible to the prevailing conditions. With known constructions the time spent in each of the chambers by the material being ground, and hence the value of the output or operating rate is in general varied by appropriate choice of slot width in the slotted plates mounted on one support plate of the lifting wall.

A disadvantage of these known constructions is that the time spent and hence the output when once selected can only be altered by major conversions of the lifting wall, for example by installing different slotted plates or covering over individual slotted plates.

SUMMARY OF THE INVENTION

The aim of the invention is therefore to avoid these disadvantages while providing a lifting wall intended for incorporation in a tube mill and which enables the output of ground material to be varied in simple manner.

According to the invention this aim is achieved in that the lifting vanes are radially adjustable.

In the trials on which the invention is based it has in fact been discovered that within certain limits a fine variation in output can be effected by radially adjusting the lifting vanes. For example, if a lifting wall is dimensioned, eg by choice of slot width, to ensure that the desired nominal output is achieved with a medium vane setting, a radial retraction of the lifting vanes will reduce the output rate, while a radial extension thereof will increase the output rate. Within certain limits the radial adjustment of the lifting vanes thus permits variation of the output rate and hence optimum utilisation of the grinding plant, without expensive conversions.

In general the radial adjustment of the lifting vanes goes hand in hand with a raising or lowering of the level of material in the preceding chamber (the level of the material normally rises if the output of the lifting wall is reduced by radial retraction of the lifting vanes). The change in the level of material in the preceding grinding chamber is accompanied by increasing or by reducing the sizes of the slots in the slotted plates, which from the grinding technique aspect is often a desirable effect.

BRIEF DESCRIPTION OF DRAWINGS

Suitable embodiments of the invention are the subject of subsidiary claims, and will be explained in detail in conjunction with the description of one embodiment shown in the drawngs. In these drawings:

DETAILED DESCRIPTION

The lifting wall 1 represented is intended for incorporation in a tube mill whereof only the wall 2 and the axis 3 are schematically indicated. The lifting wall 1 in this instance separates two adjacent grinding chambers 4, 5 of the tube mill from each other.

Figure 2:
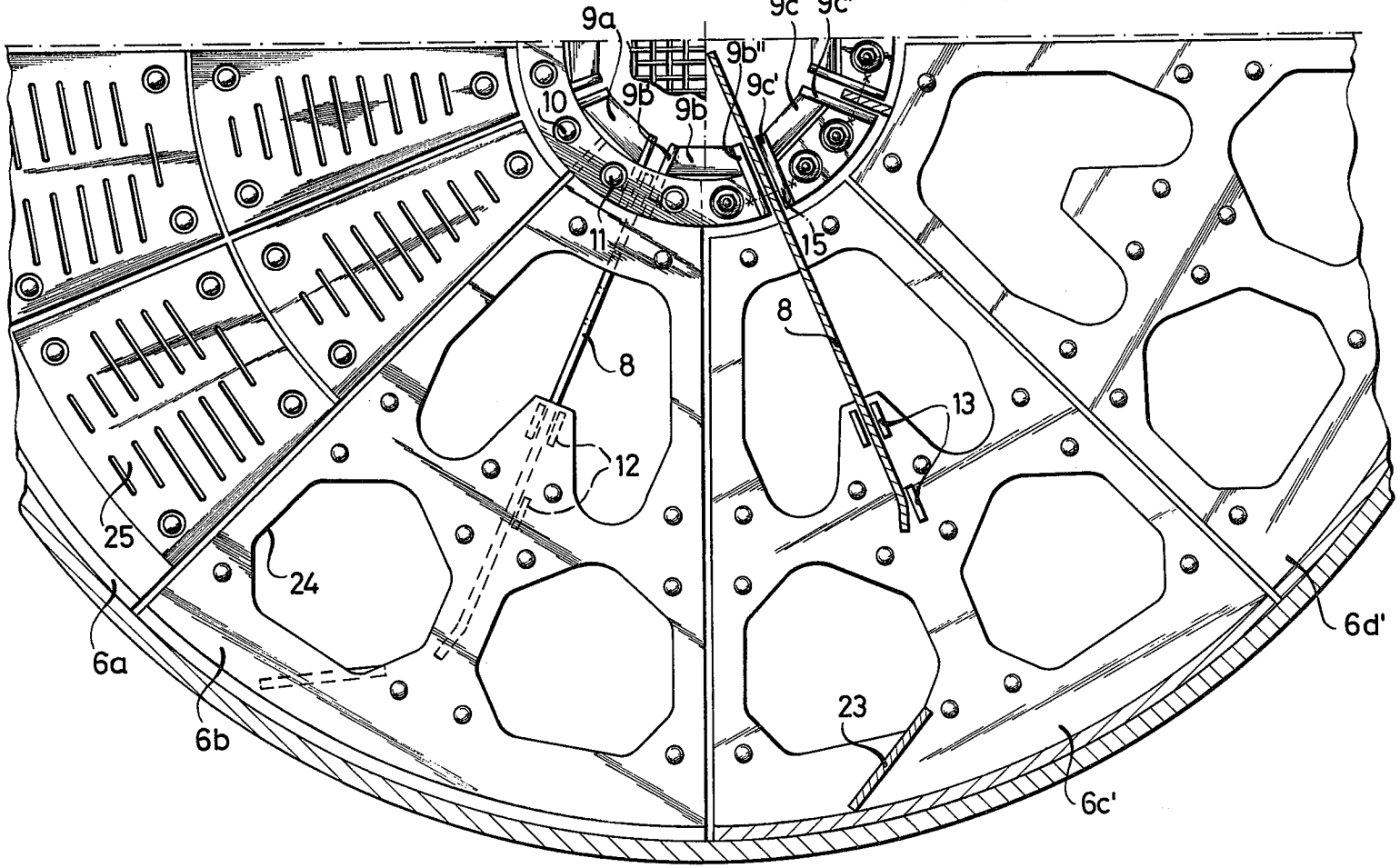
FIG. 2 is in the right-hand half a section on line II—II in FIG. 1, and in the left-hand half a plan view in the direction of arrow III in FIG. 1.

The lifting wall 1 includes two support plates 6, 6', each an assembly of eight segments. FIG. 2, shows the segments **6*a*, 6*b* of the support plate 6 and the segments 6*c'*, 6*d'* of the support plate 6'. In the vicinity of the outer rim each pair of segments (eg 6*b*, 6*b*) of the two support plates 6, 6' are joined together by a cylindrical member 7. This member 7 is screwed to the tube mill wall 2**.

Between the segments, associated in pairs, of the support plates 6, 6', for instance between segments **6*b* 6'*b* there is in each case disposed a lifting vane 8. As will be explained in more detail below, these lifting vanes 8** are radially adjustable.

A further part of the lifting wall 1 comprises a central transfer cone 9 also assembled from segments, and having the same division into segments as the two support plates 6, 6'. FIG. 2 shows inter alia the segments **9*a*, 9*b* and 9*c*. of the transfer cone 9. The segments in transfer cone 9 are each symmetrically disposed in relation to two adjacent segments of the carrier plate 6 and are screwed to those segments. Thus for example the segment 9*a* of the transfer cone 9 is connected by screws 10 and 11 to the segments 6*a* and 6*b* of the support plate 6**.

The segments of the support plates 6, 6' are provided with longitudinal guides 12, 13 for radially adjusting the lifting vanes 8. In the area of their radially inner end the lifting vanes 8 have a series of holes 14 used for fixing the lifting vanes in their required radial position.

The lifting vanes 8 are screwed to the individual segments of the transfer cone 9. For this purpose the separate segments of the transfer cone 9 have side plates (see for instance the side plates **9*b'* and 9*b''* of segment 9*b* and the side plates 9*c'*, 9*c''* of the segment 9*c*). The lifting vanes 8 each extend between the side plates (eg 9*b''*, 9*c'*) of adjacent segments (eg 9*b*, 9*c*) of the transfer cone 9 and are screwed to those side plates by screws 15**.

Therefore the holes 14 at the radial inner ends of the vanes 8 function as receptacle means, the holes in the side plates **9*b'* and 9*b''*, etc., function as mating receptacle means, and screws 15** function as fastener means.

Figure 3:
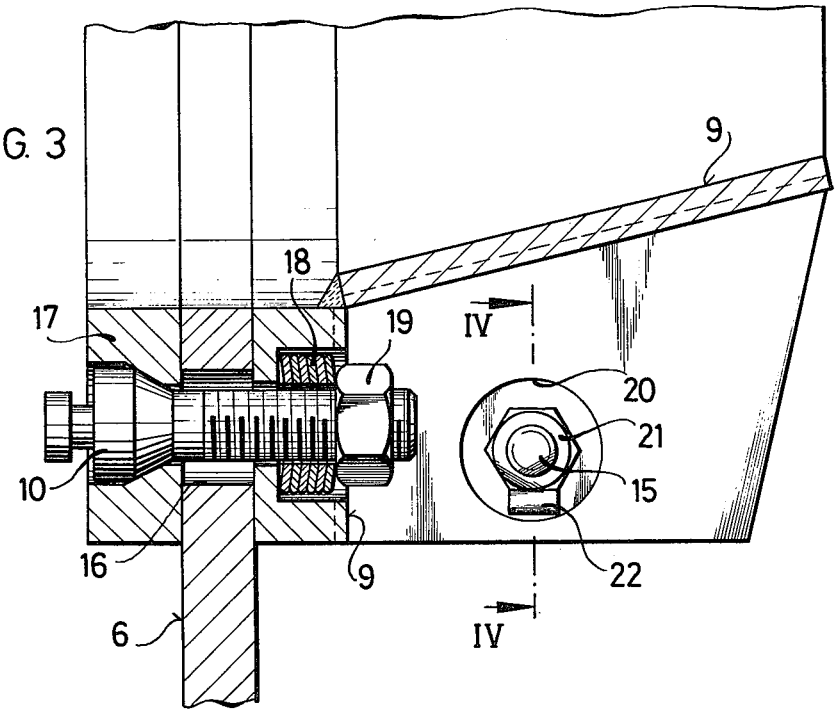
FIG. 3 is a detail from FIG. 1.
Figure 4:
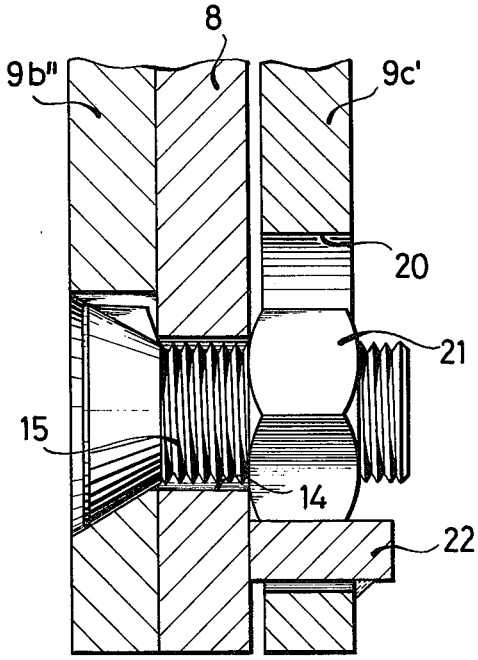
FIG. 4 is a section on the line IV—IV of FIG. 3.

FIG. 3 shows details of the connection between support plate 6 and the transfer cone 9, while FIG. 4 shows details of the connection between lifting vanes 8 and the transfer cone 9.

Figure 1:
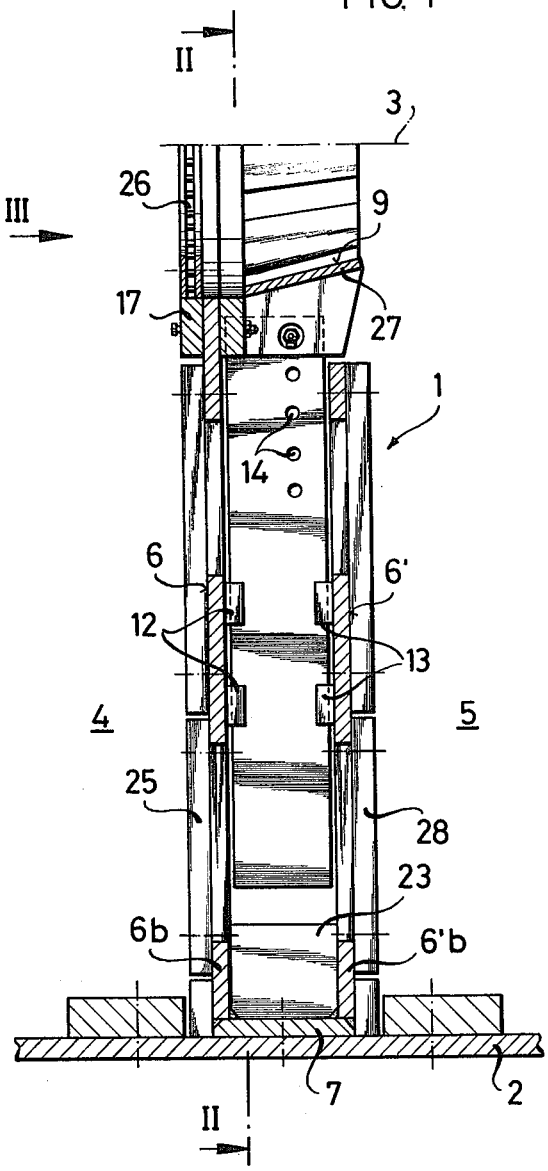
FIG. 1 is a vertical half-section through a lifting wall in accordance with the invention.

As shown By FIGS. 1 and 2, the segments (eg **6*a*, 6*b*) of the support plate 6 have a somewhat smaller internal diameter than the segments (eg 6*c'*, 6*d'*) of the support plate 6'. In the area of this inner periphery, provided with bores 16 (see FIG. 3), the segments of the support plate 6 are affixed to the segments of the transfer cone 9 by means of a clamping flange 17 and a number of screws 10, 11. As seen from FIG. 3, by choice of a sufficiently large bore 16 and the provision of resilient washers 18 an internally threaded nut 19 this joint may be constructed so that the segments in support plate 6** can make a limited compensating radial movement when varying thermal stresses occur.

FIG. 4 shows details of the connection between lifting vanes 8 and the adjacent side plates (eg **9*b''*, 9*c'*) of succeeding segments (eg 9*b*, 9*c*) in the transfer cone 9**.

The side plate 9*b*'' of segment 9*b* is provided with a bore to receive the countersunk screw 15, while the side plate 9*c*' of the adjacent segment 9*c* has a bore 20 which is big enough to permit actuation of the nut 21 by a box spanner. A flat strip 22 is also provided in this bore 20 as a nut lock.

The segments, corresponding to each other in pairs, of the two support plates 6, 6' are preferably separated from each other in their radially inner area by intermediate struts (not shown in the drawings) in order thereby to further reinforce the box profile of the lifting wall segments.

Between each pair of associated support plate segments (eg 6*b*, 6'*b*) there is disposed near the outer rim a guide plate 23 to direct the flow of material towards the lifting vane 8 concerned.

The segments of the support plates 6, 6' are provided in the normal manner with apertures 24 which in the case of plate 6 are covered by slotted plates 25 and of plate 6' by back wall plates 28.

Finally the clamping flange 17 is also provided with a grid 26 whereby the grinding bodies impinging centrally on the lifting wall are deflected.

The lifting wall as provided by the invention consequently functions as follows:

Adequately reduced ground material from the grinding chamber 4 passes through the slots in the slotted plate 25 into the intermediate space between the support plates 6, 6'. During rotary movement of the lifting wall this material is deflected by the guide plates 23 to the vanes 8 and is conveyed along these vanes to the transfer cone 9. The ground material then travels along the conical surface 27 of the transfer cone 9 to reach the grinding chamber 5.

This output from the lifting wall 1 can be varied within wide limits by the radial setting of the vanes 8; FIG. 2 shows the two possible end positions of the vanes 8. While the right-hand vane is completely retracted and hence gives the minimum output, the left-hand vane 8 is in its outermost position and hence gives rise to maximum conveyance of material between the adjacent grinding chambers.

The conversion of the lifting wall to a different radial vane setting can be carried out very quickly by removing the screw 15 (FIG. 4) sliding lifting wall 8 along its length until another one of its holes 14 registers with the holes of the side plates 9*b*'' and 9*c*', and reinserting the screw 15.

While this invention has been described in detail with particular reference to preferred embodiments thereof, it will be understood that variations and modifications can be effected within the spirit and scope of the invention as described hereinbefore and as defined in the appended claims.

What we claim is:

1. In a tube mill rotatable about an axis, the improvement therein of a lifting wall assembly comprising a pair of support plate structures in spaced approximately parallel relationship with respect to each other and disposed perpendicular to the axis of rotation of said tube mill, a transfer cone structure mounted with its longitudinal axis approximately in alignment with the axis of rotation of said tube mill and positioned between said support plate structures, and a plurality of lifting vanes positioned between said support plate structures and each vane extending approximately radially from said transfer cone structure and protruding into said transfer cone structure, said lifting vanes each being slidable along its length between said pair of support plate structures, each of said lifting vanes including a plurality of receptacle means arranged along the length of the vane, and wherein said transfer cone structure includes radially projecting side plates each including mating receptacle means whereby various ones of the receptable means of the vanes are alignable with the mating receptacle means of the side plates when the vanes are radially moved along their lengths, and further including fastener means for connecting said vanes at various ones of their receptacles to said side plates at their mating receptacles at the radial inner ends of the vanes.

2. The invention of claim 1 and wherein said support plate structures include guides for supporting and guiding said lifting vanes.

3. The invention of claim 1 and wherein said transfer cone structure defines a slot therein for each of said vanes, and wherein each of said vanes is received at one of its ends in a slot of said transfer cone structure.

4. The invention of claim 1 and further including a plurality of guide plates, each of said guide plates positioned adjacent a lifting vane and angled for directing the flow of material toward its adjacent lifting vane.

5. The invention of claim 1 and wherein a first one of said support plate structures is connected to the larger end of said transfer cone structure and the second one of said support plate structures defines an inner edge portion spaced from the smaller end of said transfer cone structure, whereby the fastener connection means of each lifting vane is accessible for changing the effective length of its lifting vane by reaching between the smaller end of the transfer cone structure and the inner edge portion of the second one of the support plate structures.

* * * * *